US009557065B2

(12) United States Patent
Fichman

(10) Patent No.: US 9,557,065 B2
(45) Date of Patent: Jan. 31, 2017

(54) FUME HOOD

(71) Applicant: Ori Fichman, Rishon LeZion (IL)

(72) Inventor: Ori Fichman, Rishon LeZion (IL)

( * ) Notice: Subject to any disclaimer, the term of this patent is extended or adjusted under 35 U.S.C. 154(b) by 77 days.

(21) Appl. No.: 14/504,855

(22) Filed: Oct. 2, 2014

(65) Prior Publication Data

US 2015/0033683 A1 Feb. 5, 2015

Related U.S. Application Data

(63) Continuation-in-part of application No. PCT/IL2013/050329, filed on Mar. 21, 2013.

(30) Foreign Application Priority Data

Apr. 5, 2012 (IL) ..... 219114

(51) Int. Cl.
*B01D 45/08* (2006.01)
*F24C 15/20* (2006.01)

(52) U.S. Cl.
CPC ..... *F24C 15/2035* (2013.01); *F24C 15/20* (2013.01); *F24C 15/2042* (2013.01)

(58) Field of Classification Search
CPC ... B01D 39/1615; B01D 45/08; B01D 47/021; F24C 15/20; F24C 15/2035
USPC ..... 55/423, 442, 443, 445, 446, 467, DIG. 36,55/486; 126/299 C, 299 D, 126/299 E, 299 F, 299 R, 300
See application file for complete search history.

(56) References Cited

U.S. PATENT DOCUMENTS 4,072,143 A * 2/1978 Gaylord ..... F24C 15/20 126/299 D
6,293,983 B1 * 9/2001 More ..... B01D 39/1615 55/486
7,947,123 B2 * 5/2011 Kwok ..... F24C 15/2035 126/299 C
8,771,408 B2 * 7/2014 Lehman ..... B01D 47/021 126/299 E

* cited by examiner

*Primary Examiner* — Jacob T Minskey
*Assistant Examiner* — Minh-Chau Pham
(74) *Attorney, Agent, or Firm* — Schwegman Lundberg & Woessner, P.A.

(57) ABSTRACT

A fume hood has a plurality of peripheral inclined drainage channels for receiving condensed grease that is gravitationally delivered thereto from a region of the fume hood thereabove. One of the drainage channels continuously extends into an adjacent drainage channel therebelow to provide a single passageway that delivers the received grease to a single grease collection hole. Each of the drainage channels is configured with a surface along which the received grease flows and which slightly extends inwardly into a hood interior from a bottom edge of a corresponding wall of the hood, and a border element which extends vertically above an inward edge of the drainage channel surface to a sufficient height which prevents the flowing grease from spilling into the hood interior.

26 Claims, 13 Drawing Sheets

24
12
17
22
22
18
22
22
22

FUME HOOD

PRIORITY APPLICATIONS

This application is a continuation-in-part under 35 U.S.C. 111(a) of International Application No. PCT/IL2013/050329, filed on Mar. 21, 2013, and published as WO/2013/150540 on Oct. 10, 2013, which application claims the benefit under 35 U.S.C. 119 to Israeli Application No. 219114, filed on Apr. 5, 2012; which applications and publication are incorporated herein by reference in their entirety.

FIELD OF THE INVENTION

The present invention relates to the field of kitchen apparatus. More particularly, the invention relates to a fume hood for filtering grease, oil and other condensable contaminants from a vaporous stream generated in kitchens, such as commercial or institutional kitchens, during cooking or frying operations.

BACKGROUND OF THE INVENTION

It is imperative that hot fumes generated by cooking apparatus be continuously vented to the atmosphere, for the health of kitchen workers. A fume hood is used to filter grease and other condensable contaminants entrained in these hot fumes, to prevent malfunction of an air ventilation system. Prior art fume hoods are disclosed for example in U.S. Pat. No. 3,490,206, U.S. Pat. No. 5,429,116, U.S. Pat. No. 5,687,707, and U.S. Pat. No. 5,906,195.

Condensed grease generally accumulates in an inclined fume hood filter, and needs to be manually cleaned on a regular basis by a time consuming procedure so as not to constitute a fire hazard. The fume hood filter is generally a metallic, labyrinth type filter whereby the hot fumes condense upon contact with the plurality of spaced baffles of the filter during each consecutive passage along a winding path through the filter. The condensed grease flows upwardly and downwardly on the face of each baffle, and collects within concave seats provided with the hood assembly, often U-shaped, within which the filter is mounted. These seats are a major source of grease accumulation and are not able to be readily cleaned, particularly since the filter is not easily, or not at all, removable. The accumulated grease also trickles by gravity onto a surface underlying the fume hood to form slippery and hazardous puddles.

It is an object of the present invention to provide a fume hood assembly that is configured in such a way so as to minimize or completely prevent the accumulation of condensed grease during cooking or frying operations.

It is an additional object of the present invention to provide a fume hood assembly that allows a filter to be mounted thereto without resulting in grease accumulation along the filter periphery.

Other objects and advantages of the invention will become apparent as the description proceeds.

SUMMARY OF THE INVENTION

The present invention provides a fume hood, comprising a plurality of peripheral inclined drainage channels for receiving condensed grease that is gravitationally delivered thereto from a region of the fume hood thereabove, wherein one of said drainage channels continuously extends into an adjacent drainage channel therebelow to provide a single passageway that delivers said received grease to a single grease collection hole.

Each of the drainage channels preferably comprises a surface along which the received grease flows and which slightly extends inwardly into a hood interior from a bottom edge of a corresponding wall of the hood, and a border element which extends vertically above an inward edge of said drainage channel surface to a sufficient height which prevents the flowing grease from spilling into said hood interior. The degree of inclination of each of the drainage channels ranges from 1 to 50 degrees with respect to a horizontal plane.

In one aspect, two drainage channels having different degrees of inclination are interfaced by a common edge.

In one aspect, two drainage channels having different degrees of inclination are interfaced by means of a rectangular step.

In one aspect, each of the drainage channels is applied with a ceramic layer. The ceramic layer may be applied to each drainage channel surface, to the corresponding border element, and to the corresponding fume hood wall from the drainage channel surface until a desired upper height above the drainage channel surface. Alternatively, the entire fume hood wall and all filter member surfaces are applied with a ceramic layer.

In one aspect, a grease collector is releasably coupled to the underside of a planar region in which the grease collection hole is formed.

In one aspect, the fume hood further comprises one or more filter members for directing received condensed grease to one of the drainage channels located therebelow.

In one aspect, the one or more filter members is inclined and is leaned against one or more support surfaces in such a way so as to be removable from the fume hood and cleanable. Each of the one or more filter members is configured to receive condensed grease from one of the support surfaces and to transfer said received grease to one of the drainage channels located therebelow.

In one aspect, the one or more filter members is of the labyrinth type and is leaned against a vertically disposed, upper support surface extending downwardly from an edge joining two inclined top walls of the hood, allowing condensed grease to gravitationally flow along said upper support surface and along filter member baffles.

The present invention is also directed to a filter member for use in a fume hood, comprising a plurality of longitudinally spaced baffles for condensing grease laden fumes upon contact therewith; front and rear surfaces defining an opening in which said plurality of baffles are mounted; upper, bottom, and side surfaces; and an oblique wall extending downwardly from said upper surface towards said front surface, extending longitudinally between said side surfaces, and leanable against an upper support surface of said fume head, wherein a plurality of longitudinally spaced through holes are formed in said oblique wall in close proximity to a bottom edge thereof, thereby allowing grease that has condensed on, and gravitationally flowed along, said upper surface to be received in said through holes and then drip onto said baffles.

The present invention provides at least the following advantages:

1. An easy to clean fume hood.
2. A removable and easy to clean filter member.
3. A fume hood in which condensed grease is prevented from accumulating on the hood periphery or on the filter periphery.

4. Preventing the accumulation of slippery and hazardous puddles.
5. Minimizing or altogether preventing a fire hazard due to the lack of accumulated grease.
6. Minimizing or altogether preventing exposure to pathogenic bacteria which are generally present in the hot, oil laden fumes that rise to the fume hood during cooking or frying operations.
7. As all condensed grease is delivered to a single grease collection hole, the bacteria rich condensed grease is assured of not dripping on top of, and contaminating, food during a cooking or frying operation.

DETAILED DESCRIPTION OF PREFERRED EMBODIMENTS

Condensed grease falls from many different regions of prior art fume hoods, usually uncontrollably and sometimes in an unpredictable fashion, forming slippery and hazardous puddles. Some of the grease condenses on many inaccessible regions of the fume hood and needs to be cleaned on a regular basis by a time consuming procedure.

The novel fume hood assembly of the present invention is provided with peripheral drainage channels that are configured such that all condensed grease is delivered to a single grease collection hole, thereby dramatically simplifying the cleaning process.

Figure 1:
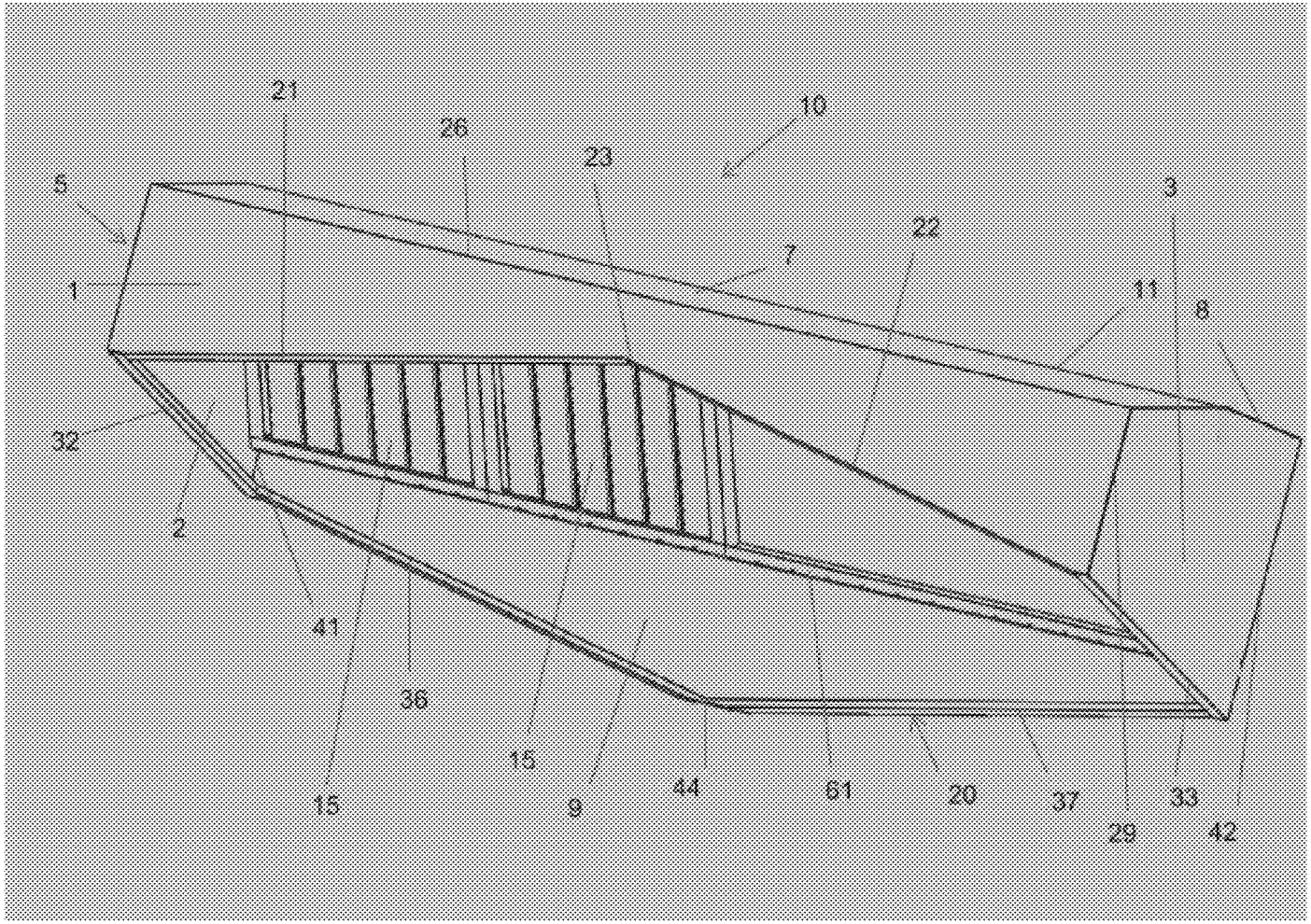
FIG. 1 is a perspective view from the front of a fume hood assembly, according to one embodiment of the present invention.

FIG. 1 illustrates a fume hood assembly generally indicated by numeral 10, according to one embodiment of the present invention. Fume hood assembly 10 overlying a cooking apparatus comprises a hood 5 into which vaporous cooking effluent (hereinafter "fumes") is introduced and a plurality of inclined filter members 15, only two of which being shown for purposes of clarity, which longitudinally extend in abutting fashion between the inner face of opposed substantially parallel, similarly configured, and vertically disposed side walls 2 and 3 of hood 5, for filtering a significant percentage of the fumes entering hood 5, e.g. 30 percent. The plurality of filter members 15 are leaned against upper and lower support surfaces, with only the lower support surface 61 being visible in the illustrated view. Although not shown, fume hood assembly 10 also comprises a ventilation system for directing the fumes into fume hood assembly 10 and for venting the filtered vapors into the surroundings. The ventilation system may be mounted on any desired wall of hood 5.

In addition to side walls 2 and 3, hood 5 comprises front wall 1, rear wall 9 substantially parallel to front wall 1 and mountable on a kitchen wall, and top inclined walls 7 and 8 which are joined at longitudinal edge 11.

Fume hood assembly 10 also comprises drainage system 20 characterized by a plurality of peripheral inclined drainage channels, each of which slightly extends inwardly into the hood interior from a bottom edge of a corresponding wall of hood 5, to receive condensed grease that falls from an overlying surface and to gravitationally deliver the received grease in a direction towards a single grease collection hole.

The hood walls are suitably configured to allow each corresponding drainage channel to gravitationally deliver the received grease in a direction towards the single grease collection hole.

As illustrated, front wall 1 has a notched configuration defining an inverted V with symmetrical drainage channels 21 and 22 that coincide at a centrally located apex 23 such that the spacing between upper edge 26, which coincides with top wall 7, and apex 23 is significantly less that the length of side edges 28 and 29 that coincide with side walls 2 and 3, respectively. Side walls 2 and 3 have drainage channels 32 and 33, respectively, which are slightly inclined downwardly towards the corresponding side edge of rear wall 9. Rear wall 9 has two drainage channels 36 and 37, respectively, that extend downwardly from the bottom of its side edges 41 and 42, respectively, and converge at region 44 located significantly below apex 23 of front wall 1.

Figure 2A:
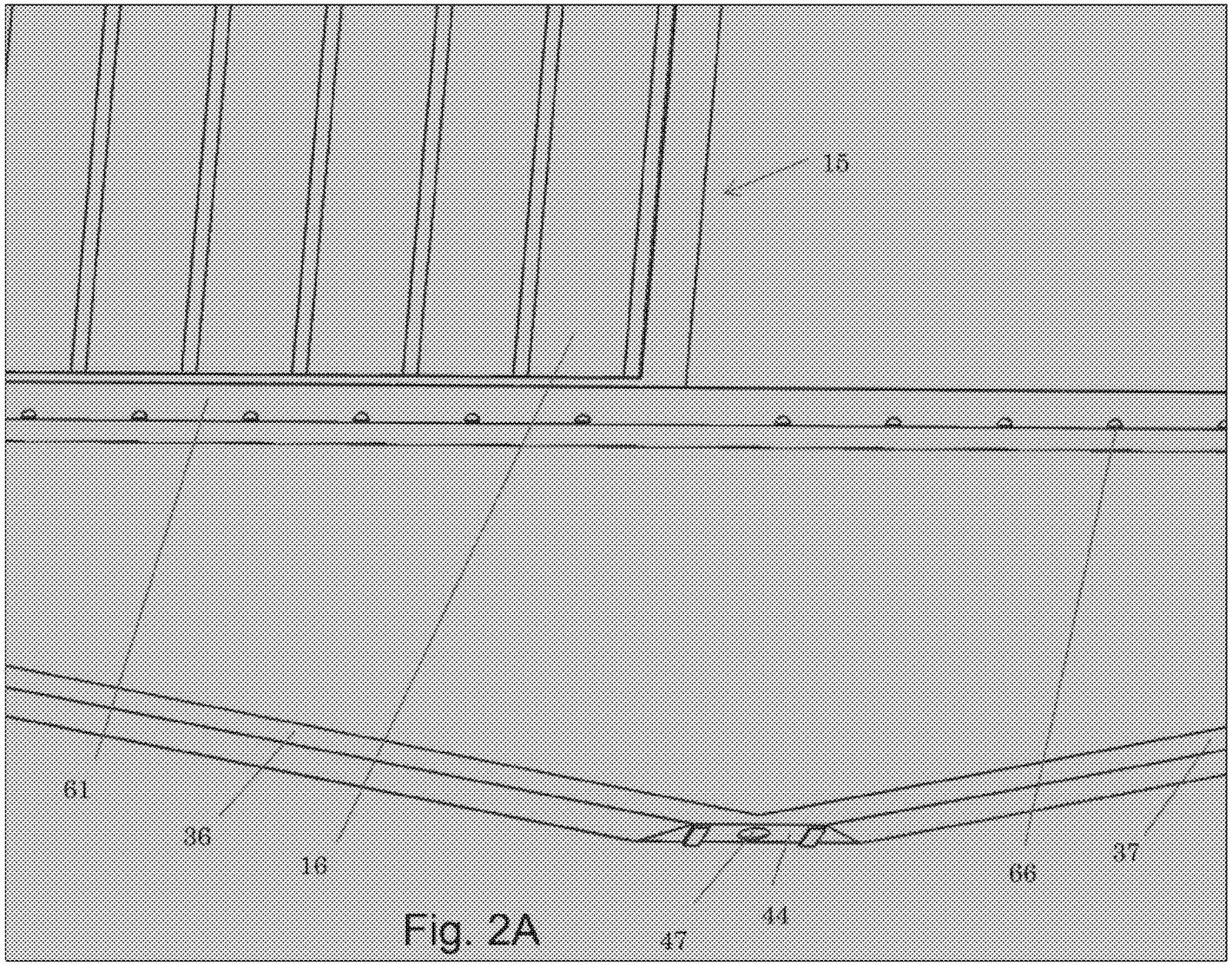
FIG. 2A is an enlargement of FIG. 1, showing the single grease collection hole from the bottom of a planar region in which it is formed.

Each drainage channel smoothly and continuously extends into an adjacent drainage channel therebelow to provide a single passageway to the grease collection hole. For example, grease falling from edge 26 will be received by drainage channel 21, and will then be delivered via channels 32 and 36 to planar region 44 in which grease collection hole 47 shown in FIG. 2A is formed.

Figure 2B:
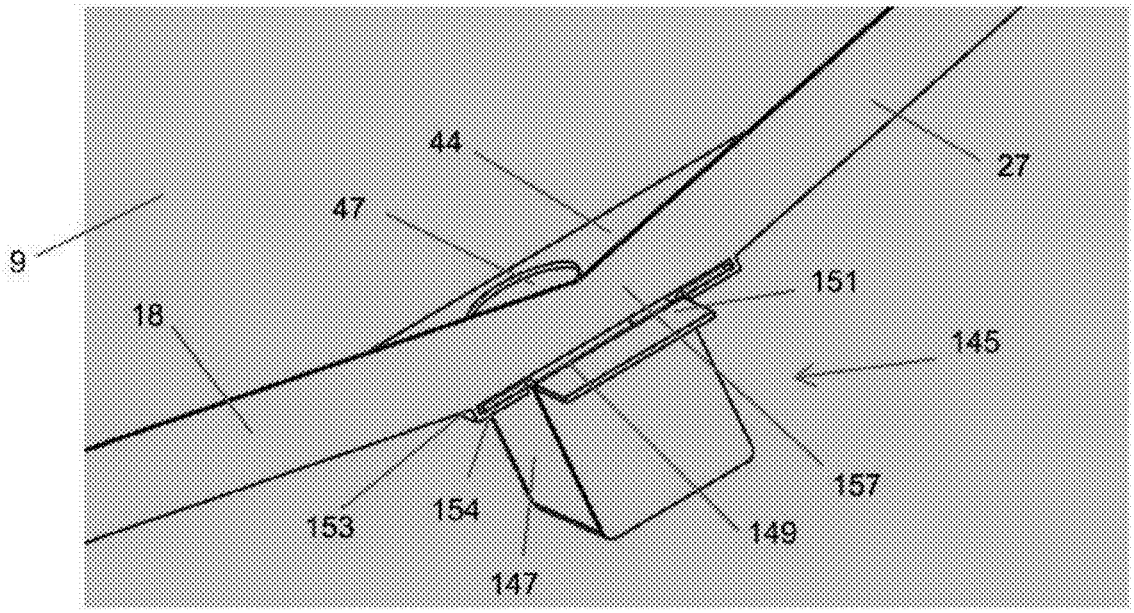
FIG. 2B is a perspective view from the top of the planar region of FIG. 2A, showing a grease collector coupled thereto.
Figure 2C:
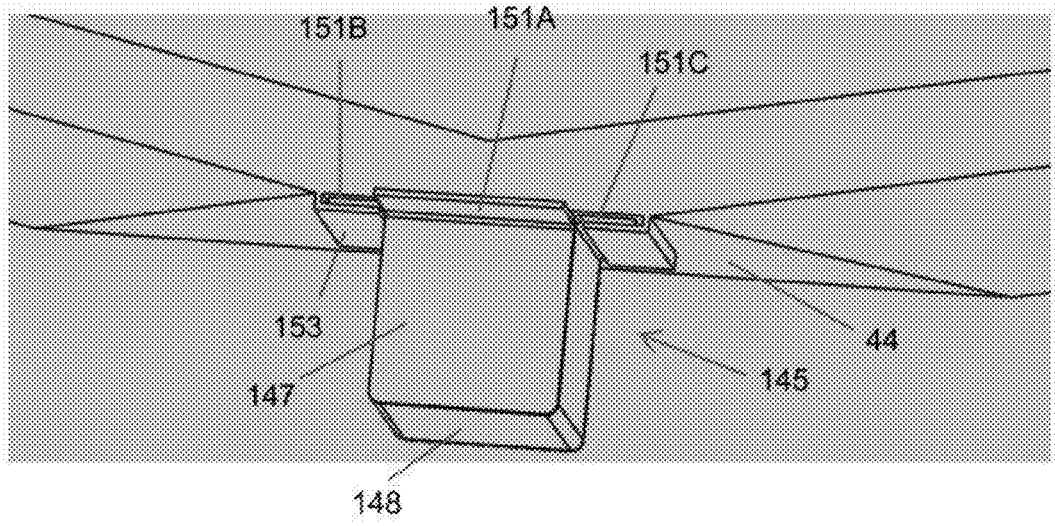
FIG. 2C is a perspective view from the bottom of the grease collector of FIG. 2B when coupled to the planar region.

A grease collector, for example grease collector 145 shown in FIGS. 2B and 2C, may be coupled to the underside of planar region 44. Grease collector 145 is a rigid rectilinear receptacle having a plurality of walls 147, a bottom 148, and a plurality of planar appendages 151, each of which extending outwardly and immovably from an upper edge 149 of a corresponding wall 147. It will be appreciated, however, that grease collector 145 may assume other desired configurations as well.

A slot enclosure 153, which may be U-shaped, is provided below planar region 44, extending from interface region 157 of drainage channel border elements 18 and 27 to rear wall 9. After opposing side appendages 151B-C are inserted within slot 154, grease collector 145 becomes coupled to slot enclosure 153 and to planar region 44, allowing grease to be gravitationally delivered through grease collection hole 47 into the interior of grease collector 145. Upon pulling on front appendage 151A, grease collector 145 may be detached from slot enclosure 153, in order to be emptied.

Figure 11:
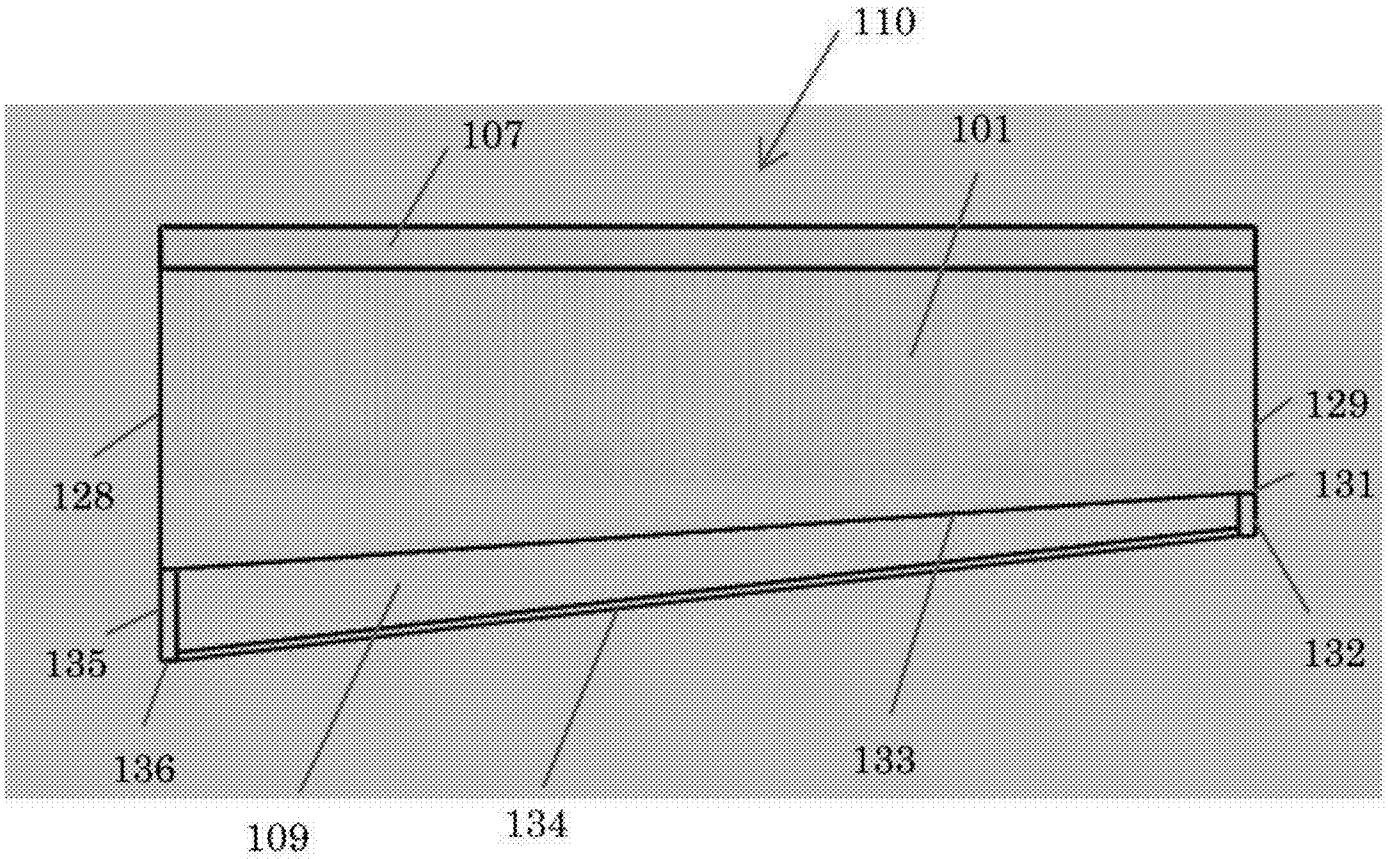
FIG. 11 is a front view of a fume hood, according to another embodiment of the invention.

It will be appreciated that the walls of the hood and the drainage channels inwardly extending from a bottom edge thereof may be configured in many other ways, such as fume hood 110 illustrated in FIG. 11, insofar as they all provide a single continuous passageway to the grease collection hole.

Figure 3:
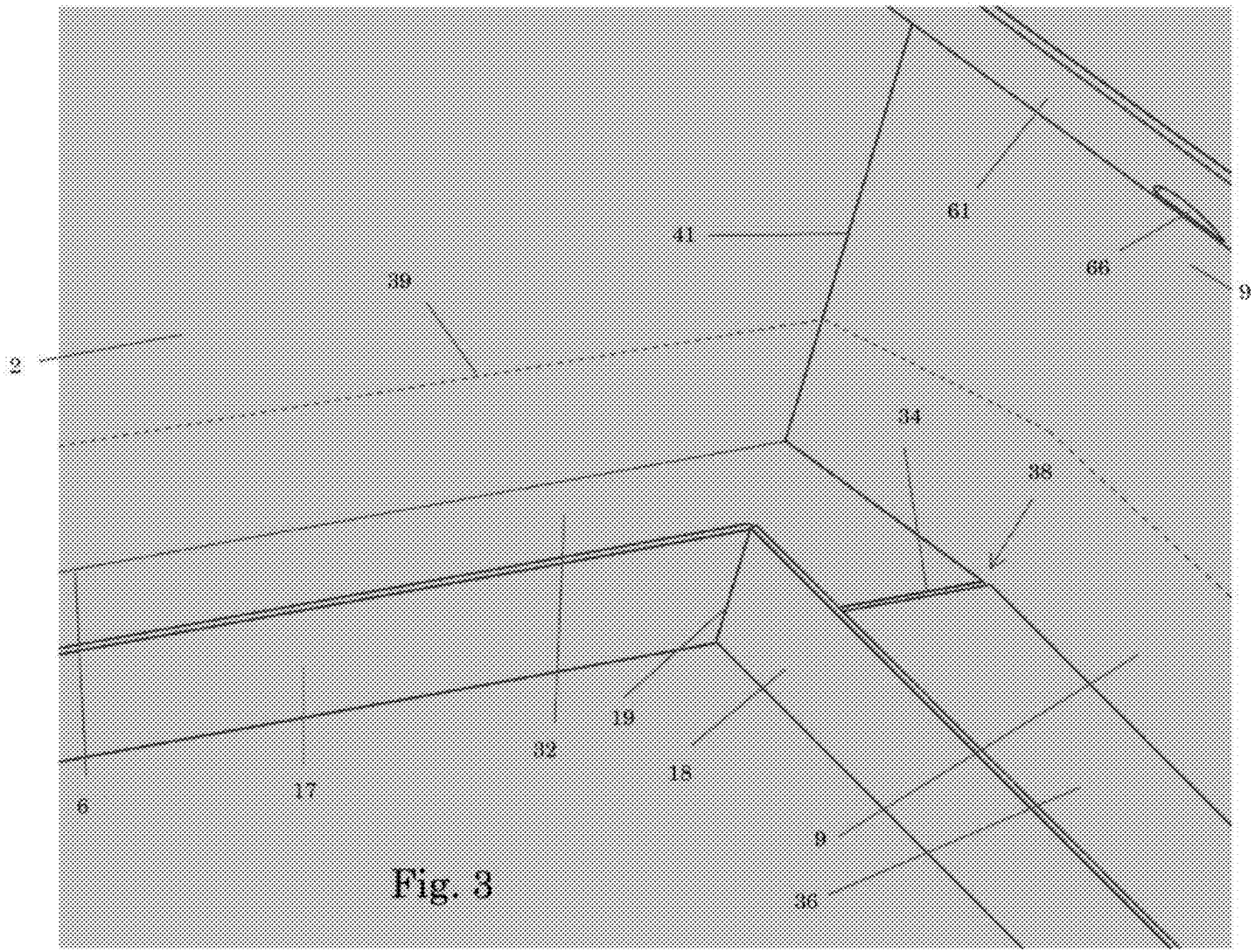
FIG. 3 is a perspective view from within the interior of the fume hood of FIG. 1, showing an interface region between two drainage channels according to one embodiment of the present invention.

FIG. 3 illustrates an interface region 38 between two drainage channels 32 and 36 having different degrees of inclination ranging from 1 to 50 degrees with respect to a horizontal plane. Drainage channel 32 inwardly extends from the bottom edge 6 of side wall 2 to border element 17, which sufficiently extends vertically above the surface of drainage channel 32 in order to prevent the grease flowing therealong from spilling into the hood interior. Border element 17 transversally extends to vertical edge 19, at which border element 18 of drainage channel 36 is joined. Edge 19 is spaced frontwardly and inwardly from edge 41 joining side wall 2 and rear wall 9, in order to accommodate the common edge 34 between drainage channels 32 and 36 which extends from vertical edge 19 to rear wall 9, allowing grease to flow continuously to drainage channel 36.

A ceramic layer may be applied to all drainage channels of the fume hood in order to increase grease flowability, including the drainage channel surface, both faces of the corresponding border element, and along the inner face of the corresponding fume hood wall from the drainage channel surface until a desired upper height 39 above the drainage channel surface, e.g. 10 cm, as schematically indicated by the dashed lines.

If so desired, the ceramic layer may be applied to the entire surface of the fume hood and filter members walls.

Figure 4:
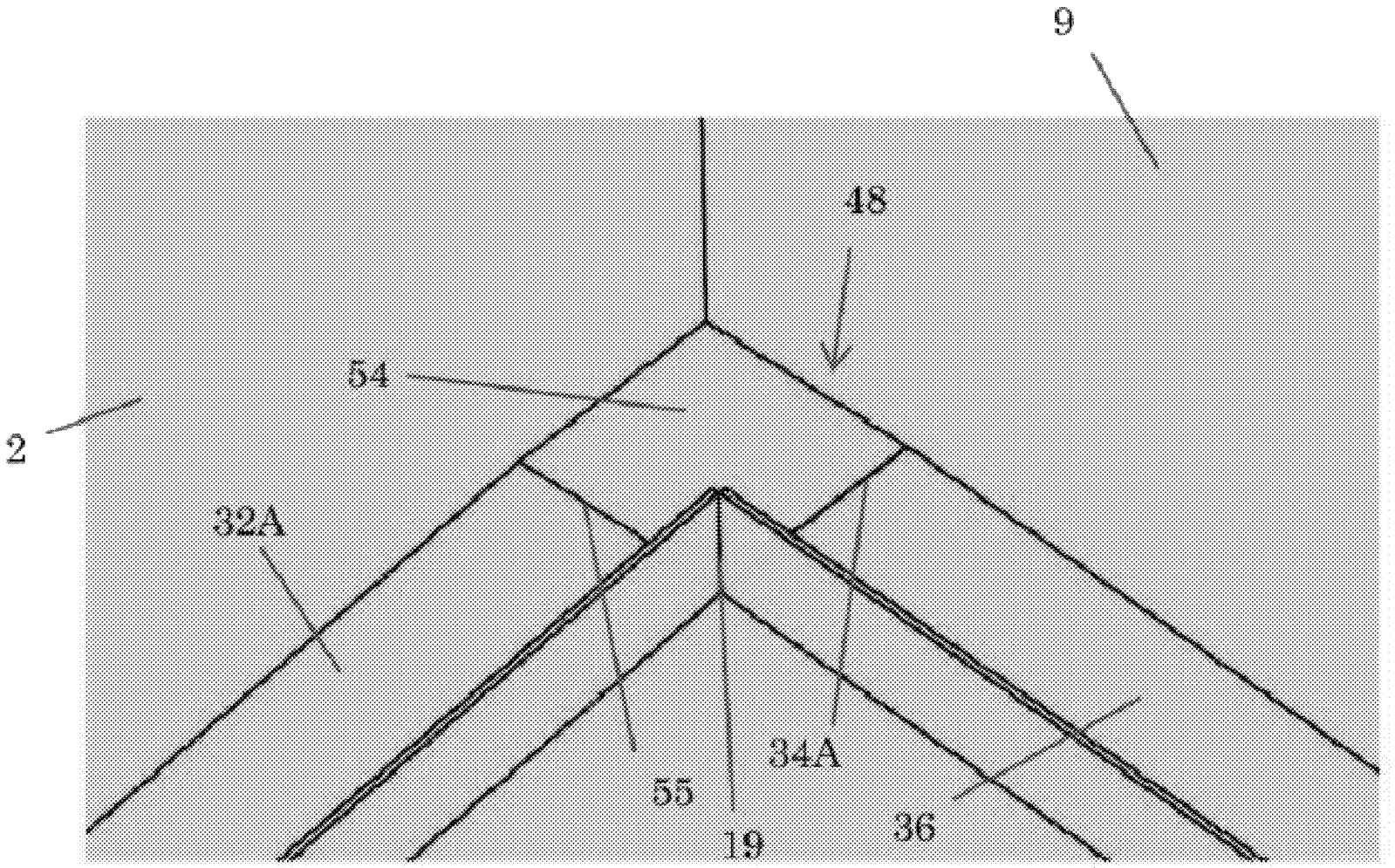
FIG. 4 is a perspective view from within the interior of the fume hood of FIG. 1, showing an interface region between two drainage channels according to another embodiment of the present invention.

FIG. 4 illustrates another type of interface region 48 between drainage channels 32A and 36 for allowing continuous flow of grease therebetween. Interface region 48 includes a rectangular step 54 positioned between edge 34A extending transversally from vertical edge 19 to rear wall 9 and edge 55 extending longitudinally from vertical edge 19 to side wall 2.

Figure 5:
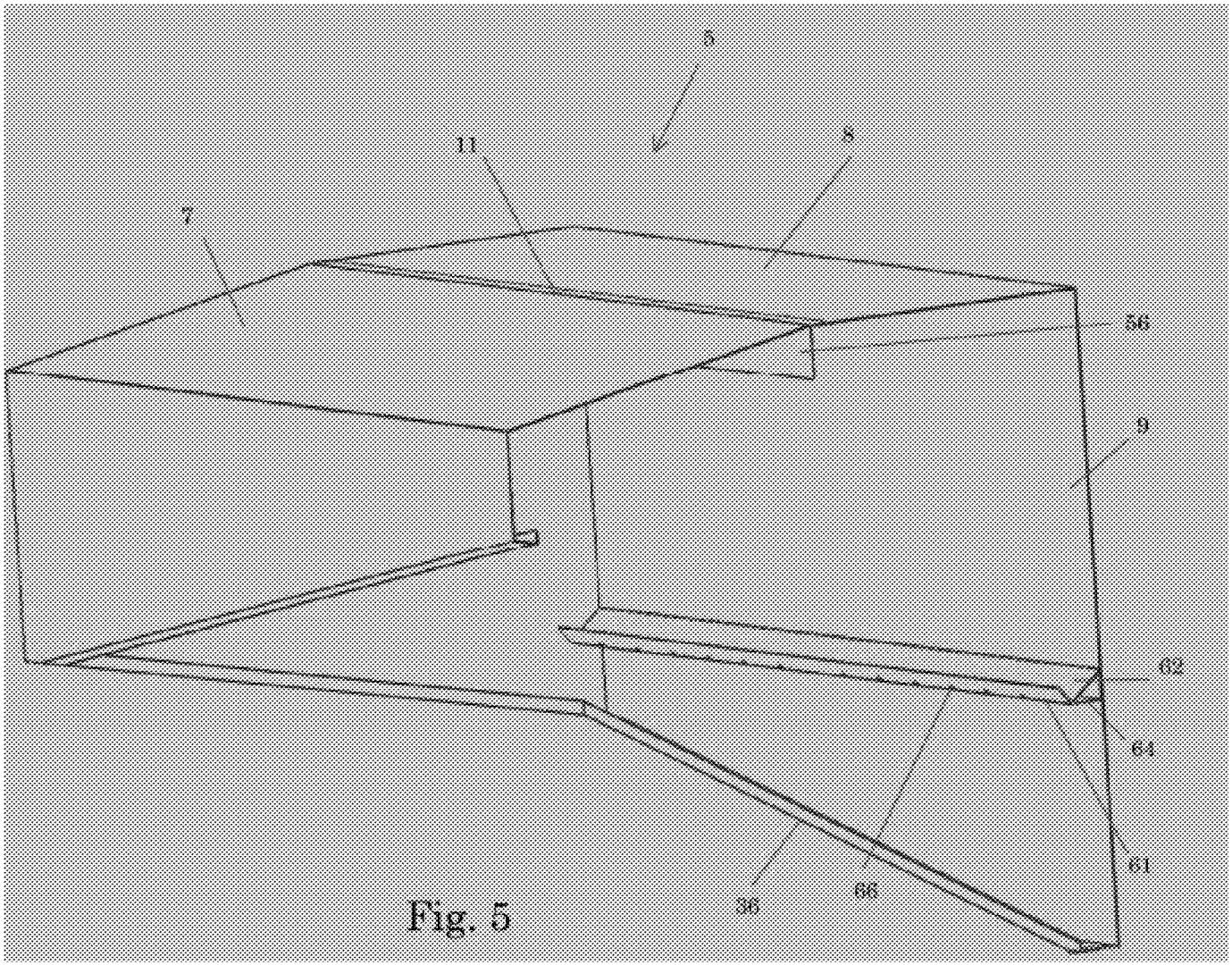
FIG. 5 is a perspective view from the top and side of the fume hood of FIG. 1, while a portion thereof including one of its side walls is removed.

FIG. 5 illustrates the structure of hood 5 while a portion thereof including one of its side walls is removed, for clarity. A vertically disposed, upper support surface 56 extends downwardly from edge 11 joining top walls 7 and 8. A mounting surface 62 extends downward and obliquely from rear wall 9, and a lower support surface 61 extends upwardly and substantially perpendicularly from mounting surface 62. A bracing surface 64 for supporting the weight of the filter member extends from the junction of lower support surface 61 and mounting surface 62 to rear wall 9, and is located below mounting surface 62. Lower support surface 61 is preferably formed with a plurality of longitudinally spaced apertures 66 through which grease condensed by baffles 16 of filter member 15 is dischargeable, as also shown in FIG. 2. An aperture 66 may be aligned with each baffle 16. Drainage channel 36 is suitably configured to receive the grease discharged from apertures 66, as further shown in FIG. 3. Surfaces 56, 61, 62 and 64 may extend the entire longitudinal length of hood 5. Mounting surface 62 may be welded to rear wall 9 to prevent the passage of grease into the cavity between surfaces 62 and 64.

Figure 6:
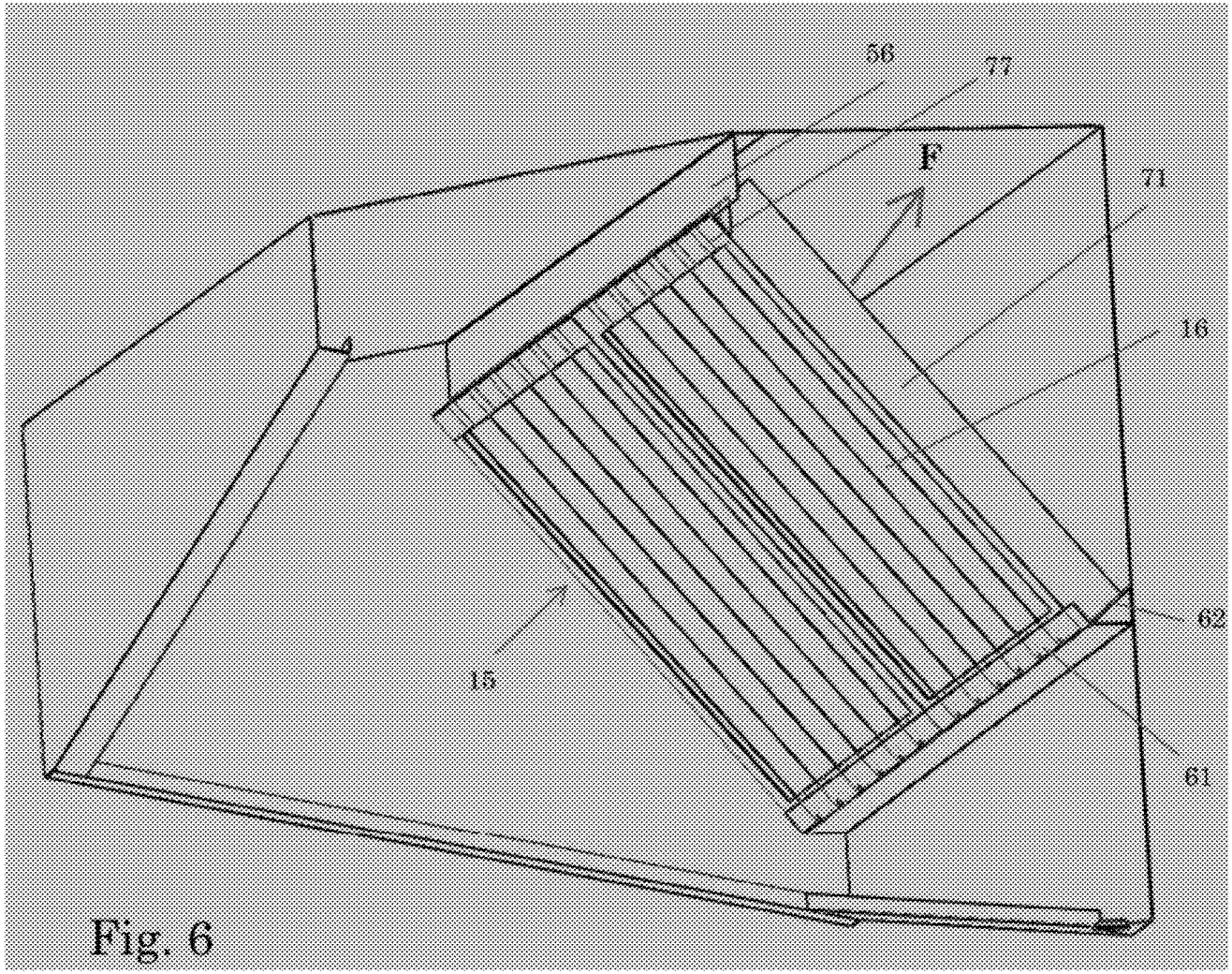
FIG. 6 is a perspective view from the side of the fume hood of FIG. 1, while a portion thereof including one of its side walls is removed, showing two filter members as they are leaned against support surfaces of the fume hood.

FIG. 6 illustrates two filter members 15 as they are leaned against upper support surface 56 and lower support surface 61. Each filter member 15 is of rectilinear configuration, to allow a side wall 71 thereof to be placed in abutting relation with an adjacent filter member and to allow its bottom surface which is substantially perpendicular to side wall 71 to be placed in abutting relation with mounting surface 62 while a bottom region of a frame element is leaned against lower support surface 61. The height of lower support surface 61 is sized so as not to interfere with the baffle elements 16 of filter member 15, i.e. the height of lower support surface 61 is less than the height of the frame element bottom region.

Figure 7:
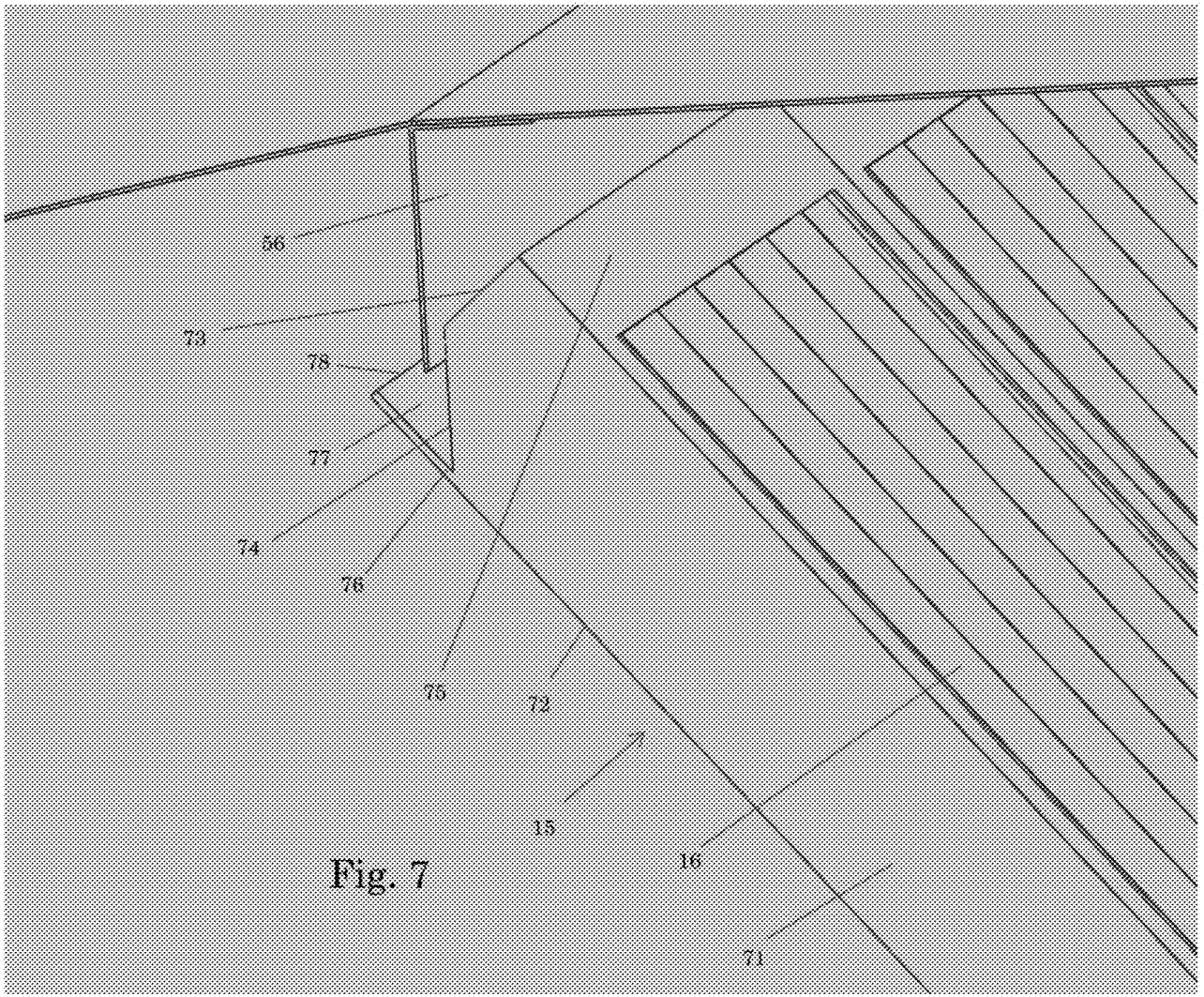
FIG. 7 is an enlarged perspective view from the side of the filter member of FIG. 6 as it is leaned against one of the support surfaces.
Figure 8:
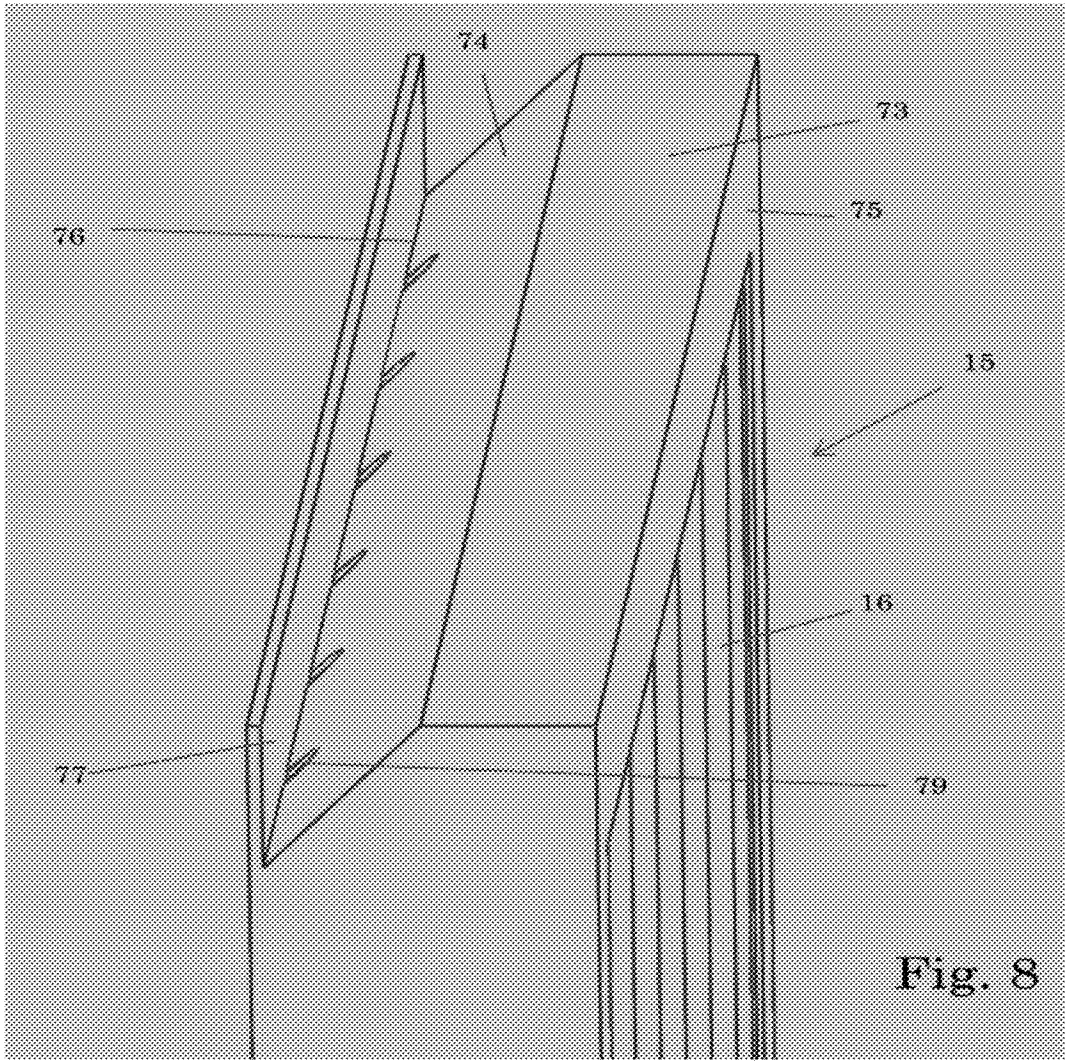
FIG. 8 is a perspective view from the top of the filter member of FIG. 6.

As further shown in FIGS. 7 and 8, the side walls 71 of each filter member 15 are formed with a V-shaped notch, defining an oblique wall 74 extending downwardly from an intermediate region of upper planar surface 73 towards front surface 72. Upper surface 73 extends from oblique wall 74 to rear surface 75 which defines an opening for baffles 16. A thin protrusion element 77 coincident with front surface 72 extends upwardly from the bottom edge 76 of oblique wall 74 to an upper edge 78 that is substantially coplanar with upper surface 73. A plurality of longitudinally spaced through holes 79 are formed in oblique wall 74, preferably coinciding with bottom edge 76 thereof.

An upper portion of oblique wall 74 is adapted to lean against upper support surface 56 of the hood. Accordingly, grease that was entrained in fumes that were not directed to the filter members 15 and condensed on the substantially vertical hood upper support surface 56 is advantageously able to flow downwardly along upper support surface 56 and then fall onto protrusion element 77, or alternatively onto oblique wall 74. The condensed grease then gravitationally flows to bottom edge 76, whereupon it is received within through holes 79. By virtue of the inclination of filter members 15, which is approximately 45 degrees with respect to the horizontal plane, the grease drips from holes 79 onto the baffles.

With reference also to FIG. 6, protrusion element 77 also serves to retain filter member 15 in leaning engagement with the support surfaces. A rearwardly directed force F generated by the ventilation system acts on filter member 15 while the fumes pass therethrough. Occasionally, force F is excessive, for example due to a ventilation system malfunction, drawing filter member 15 away from lower support surface 61. Without provision of protrusion element 77, filter member 15 is liable to be damaged due to a lack of stability. Protrusion element 77 is advantageously caused to be brought in engagement with upper support surface 56 when an excessive force F is acting on filter member 15.

Filter member 15 is also removable from upper support surface 56 and lower support surface 61, in order to be cleaned. When filter member 15 is displaced. until bottom edge 76 of oblique wall 74 contacts upper support surface 56 and is then tilted, its upper surface 73 will be able to pass below upper support surface 56 after filter member 15 is displaced frontwardly. The removability of filter member 15 constitutes a significant advancement with respect to prior art fume hoods by the increased ease by which it is able to be cleaned.

Due to the inability, or the great difficulty, to detach a filter from a prior art fume hood, condensed grease collects within the concave seats in which the filter is mounted, often overflowing. A filter of a prior art fume hood can therefore be cleaned only by a tedious and time consuming operation, particularly due to the structure of the filter seats and the resulting inaccessibility of the condensed grease.

Figure 9:
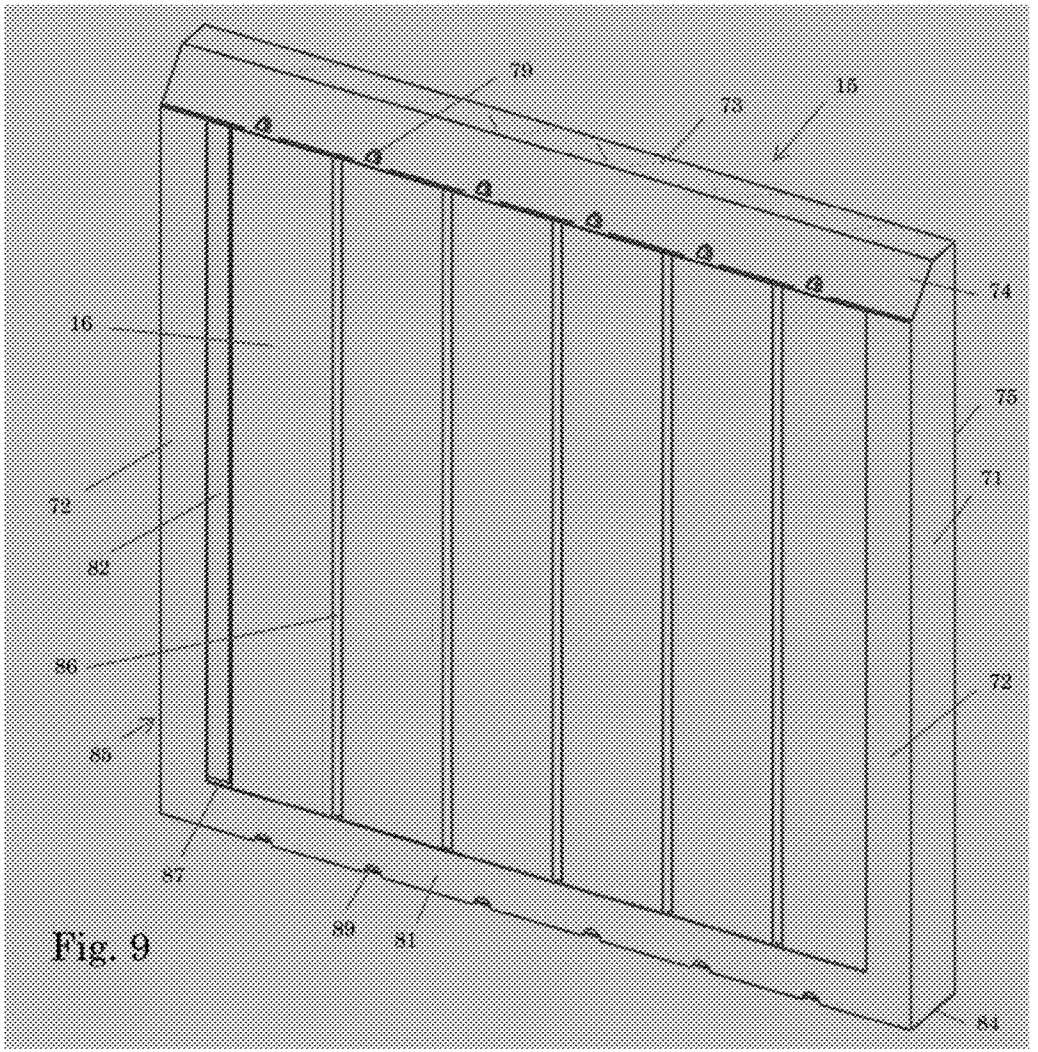
FIG. 9 is a perspective view from the front of the filter member of FIG. 6, while the protrusion element is removed.

As shown in FIG. 9, which illustrates a front perspective view of metallic, labyrinth type filter member 15 while the protrusion element is removed for purposes of clarity, the plurality of baffles 16 are recessed from frame element 85 of filter member 15. Each baffle 16 is longitudinally separated from an adjacent baffle by an interspace 86 through which the hot fumes pass. During each consecutive passage alternately forwardly and rearwardly through a different interspace 86, the fumes increasingly condense upon contact with the baffles.

Frame element 85 comprises two side walls 71, front surface 72 perpendicular to, and in abutting relation with, a corresponding side wall 71, a bottom region 81 of front surface 72 which extends between the two side walls 71 and is disposed below baffles 16, bottom surface 84 substantially perpendicular to side walls 71 and bottom region 81, rear surface 75 substantially perpendicular to side walls 71, upper surface 73 substantially perpendicular to rear surface 75, oblique wall 74, and the protrusion element.

Since the plurality of baffles 16 are recessed from frame element 85, a connecting surface 87 extends rearwardly from the top of bottom region 81 to the baffles 16 and longitudinally between the two inner walls 82 of front surface 82. A plurality of longitudinally spaced through holes 89 are formed in bottom region 81, extending obliquely from connecting surface 87. Each of these through holes is preferably aligned with a corresponding aperture 66 formed in lower support surface 61 (FIG. 2A). The grease that condenses on the upper support surface will be received within the upper through holes 79 until being introduced to a corresponding baffle 16, flow downwardly along the baffles until being received in a corresponding lower through hole 89, be transferred to a corresponding aperture 66 from which it is discharged to drainage channel 36 or 37, and then flow gravitationally along the drainage channel to grease collection hole 47. Thus filter member 15 is configured to interface with the support surfaces of the fume hood to facilitate reliable and effortless cleaning of substantially all of the condensed grease.

Figure 12:
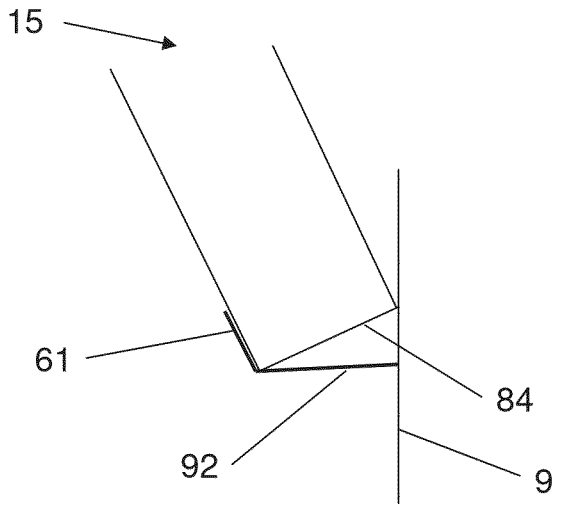
FIG. 12 is a side view of the filter member of FIG. 6 as it is removably secured by two-point contact to a portion of a fume hood, according to another embodiment of the invention.

In another embodiment shown in FIG. 12, bottom surface 84 of filter member 15 may be removably secured by two-point contact with lower support surface 61 and with rear wall 9 of the hood, without need of an additional mounting surface. Surface 92 extending from lower support surface 61 to rear wall 9 is inclined, for example at an angle greater than 3 degrees with respect to a horizontal plane, so that grease discharged from filter member 15 will be gravitationally delivered towards lower support surface 61.

Figure 13:
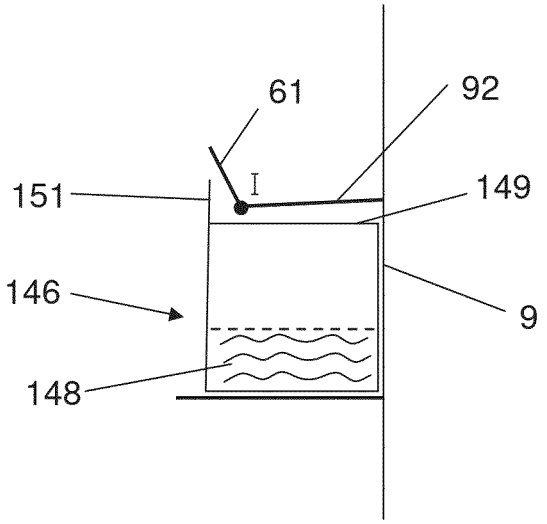
FIG. 13 is a side view of a grease collector removably coupled to the fume hood portion of FIG. 12.

As shown in FIG. 13, grease collector 146 releasably secured to rear wall 9, or to any other portion of the hood, is positioned below the interface I of surfaces 61 and 92. As a plurality of longitudinally spaced apertures are formed in interface I, the grease gravitationally delivered to interface I is discharged via the apertures to the interior 148 of grease collector 146. Grease collector 146 has a protective surface 151 that vertically extends above the upper lip 149 bordering interior 148, to prevent sparks or any flammable fumes from being introduced into grease collector interior 148 and to thereby prevent ignition of the collected grease.

It will be appreciated that a filter member 15 that interfaces with upper and lower support surfaces will also facilitate the cleaning of a fume hood provided without peripheral inclined drainage channels.

Figure 10:
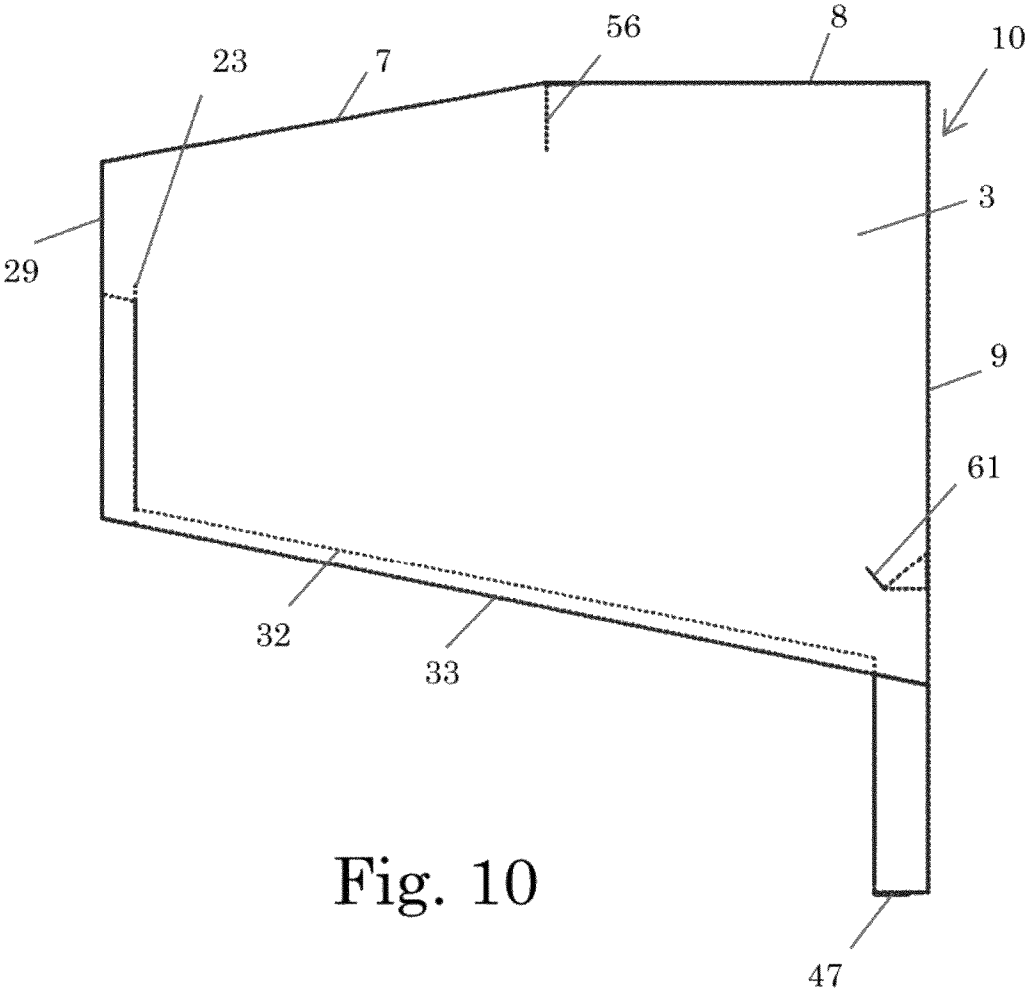
FIG. 10 is a side view of the fume hood of FIG. 1.

A side view of fume hood 10 is shown in FIG. 10, to illustrate how all the drainage channels are configured to lead to grease collection hole 47.

A front view of a fume hood 110 is illustrated in FIG. 11, according to another embodiment of the invention. Front wall 101 extending downwardly from top wall 107 is trapezoidal wherein first side edge 128 thereof is longer than its second side edge 129. Rear wall 109 extends below front wall 101. Front wall 101 and rear wall 109 are provided with drainage channels 133 and 134, respectively, which slope downwardly to the left with respect to the illustrated orientation. Grease collection hole 136 is located at the lowermost region of drainage channel 134.

The bottom edge 131 of second side edge 129 is the highest region of the plurality of drainage channels that form a single passageway. Condensed grease can gravitationally flow from edge 131 either along drainage channel 133 or along side wall drainage channel 132 extending to drainage channel 134. A side wall drainage channel 135 extends from the lowermost region of front wall 101 to rear wall 109, to deliver grease to grease collection hole 136.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

What is claimed is:

1. A fume hood, comprising one or more peripheral walls defining a fume hood interior; and a plurality of inclined drainage channels adjoining a corresponding region of said one or more walls, for receiving condensed grease that is gravitationally delivered thereto from a different region of the fume hood thereabove, wherein at least three of said drainage channels are disposed at different inclination angles with respect to a vertical plane, and wherein a first of said at least three drainage channels continuously extends into a second of said at least three drainage channels therebelow, and said second of said at least three drainage channels continuously extends into a third of said at least three drainage channels therebelow to provide a single passageway that delivers said received grease to a single grease collection hole.

2. The fume hood according to claim 1, wherein each of the drainage channels comprises a surface fixed to the one or more walls along which the received grease flows and which slightly extends inwardly into said hood interior from a bottom edge of a corresponding wall of the hood, and a border element which extends vertically above an inward edge of said drainage channel surface to a sufficient height which prevents the flowing grease from spilling into said hood interior.

3. The fume hood according to claim 2, wherein two of the drainage channels having different degrees of inclination are interfaced by a common edge.

4. The fume hood according to claim 2, wherein two of the drainage channels having different degrees of inclination are interfaced by means of a rectangular step.

5. The fume hood according to claim 1, further comprising one or more filter members for directing received condensed grease to one of the drainage channels located therebelow.

6. The fume hood according to claim 5, further comprising one or more support surfaces, wherein the one or more filter members is inclined and is removably leaned against said one or more support surfaces in such a way so as to be removable from the fume hood and cleanable.

7. The fume hood according to claim 6, wherein each of the one or more filter members is configured to receive condensed grease from one of the support surfaces and to transfer said received grease to one of the drainage channels located therebelow.

8. The fume hood according to claim 7, wherein the one or more support surfaces is a vertically disposed, upper support surface extending downwardly from an edge joining two inclined top walls of the hood, and wherein the one or more filter members is of the labyrinth type and is leaned against said vertically disposed, upper support surface, allowing condensed grease to gravitationally flow along said upper support surface and along filter member baffles.

9. The fume hood according to claim 8, wherein each of the one or more filter members has a rectilinear frame element to allow a side wall of a first filter member to be placed in abutting relation with a side wall of a second filter member.

10. The fume hood according to claim 9, wherein the frame element comprises:

front and rear surfaces defining an opening in which a plurality of longitudinally spaced baffles are mounted;

upper and bottom surfaces substantially perpendicular to the sides walls; and a V-shaped notch formed in the side walls defining:

an oblique wall extending downwardly from said upper surface towards said front surface, extending longitudinally between the side walls, and leanable against the upper support surface; and a protrusion element engageable with the upper support surface when an excessive ventilation derived force acts on the filter member, said protrusion element being coincident with said front surface and extending upwardly from a bottom edge of said oblique wall.

11. The fume hood according to claim 10, wherein an upper edge of the protrusion element is substantially coplanar with the upper surface of the frame element.

12. The fume hood according to claim 10, wherein a plurality of longitudinally spaced through holes are formed in the oblique wall in close proximity to the bottom edge thereof, thereby allowing condensed grease to be received in said through holes and then drip onto the baffles.

13. The fume hood according to claim 10, wherein the bottom surface of the frame element is placeable in abutting relation with a mounting surface extending downwardly and obliquely from a rear wall of the hood which is mountable on a kitchen wall.

14. The fume hood according to claim 13, wherein a bottom region of the front surface of the frame element is leaned against a lower support surface extending upwardly and substantially perpendicularly from the mounting surface.

15. The fume hood according to claim 14, wherein a bracing surface for supporting the weight of the filter member extends from a junction of the lower support surface and the mounting surface to the rear wall, and is located below the mounting surface.

16. The fume hood according to claim 14, wherein a plurality of longitudinally spaced through holes are formed in the bottom region and in a connecting surface extending rearwardly from the bottom region to the baffles, allowing the condensed grease flowing along the baffles to be discharged from the filter member.

17. The fume hood according to claim 16, wherein the lower support surface is formed with a plurality of longitudinally spaced apertures for receiving the condensed grease discharged from the filter member and for transferring the same to one of the drainage channels located therebelow.

18. The fume hood according to claim 16, wherein each of the apertures formed in the lower support surface is aligned with a corresponding through hole formed in the bottom region of the frame element.

19. The fume hood according to claim 14, wherein the height of the lower support surface is substantially equal to the height of the bottom region of the frame element.

20. The fume hood according to claim 2, wherein each of the drainage channels is applied with a ceramic layer.

21. The fume hood according to claim 20, wherein the ceramic layer is applied to each drainage channel surface, to the corresponding border element, and to the corresponding fume hood wall from the drainage channel surface until a desired upper height above the drainage channel surface.

22. The fume hood according to claim 21, wherein the entire fume hood wall and all filter member surfaces are applied with a ceramic layer.

23. The fume hood according to claim 1, wherein a grease collector is releasably coupled to the underside of a planar region in which the grease collection hole is formed.

24. The fume hood according to claim 2, wherein each of the drainage channels has a degree of inclination ranging from 1 to 50 degrees with respect to a horizontal plane.

25. A filter member for use in a fume hood, comprising:

a plurality of longitudinally spaced baffles for condensing grease laden fumes upon contact therewith;

front and rear surfaces defining an opening in which said plurality of baffles are mounted;

upper, bottom, and side surfaces; and an oblique wall extending downwardly from said upper surface towards said front surface, extending longitudinally between said side surfaces, and leanable against an upper support surface of said fume head, wherein a plurality of longitudinally spaced through holes are formed in said oblique wall in close proximity to a bottom edge thereof, thereby allowing grease that has condensed on, and gravitationally flowed along, said upper surface to be received in said through holes and then drip onto said baffles.

26. The filter member according to claim 25, further comprising a protrusion element engageable with the upper support surface when an excessive ventilation derived force acts on the filter member, said protrusion element being coincident with the front surface and extending upwardly from the bottom edge of the oblique wall.

* * * * *